US008083910B2

(12) United States Patent
Mizuno

(10) Patent No.: US 8,083,910 B2
(45) Date of Patent: Dec. 27, 2011

(54) INSULATING SPACER FOR PLATING INNER SURFACE AND AUXILIARY ANODE UNIT

(75) Inventor: Chikanori Mizuno, Nagoya (JP)

(73) Assignee: Daiwa Excel Co., Ltd., Aichi (JP)

( * ) Notice: Subject to any disclaimer, the term of this patent is extended or adjusted under 35 U.S.C. 154(b) by 306 days.

(21) Appl. No.: 12/532,707

(22) PCT Filed: Mar. 26, 2007

(86) PCT No.: PCT/JP2007/056263

§ 371 (c)(1),
(2), (4) Date: Sep. 23, 2009

(87) PCT Pub. No.: WO2008/117403

PCT Pub. Date: Oct. 2, 2008

(65) Prior Publication Data

US 2010/0116651 A1 May 13, 2010

(51) Int. Cl.
*C25B 9/02* (2006.01)

(52) U.S. Cl. ..... 204/279; 204/280; 204/286.1; 204/288.1; 204/297.01

(58) Field of Classification Search ..... 204/279, 204/280, 286.1, 288.1, 297.01; 205/118, 205/131, 132, 151
See application file for complete search history.

(56) References Cited

U.S. PATENT DOCUMENTS 6,103,076 A * 8/2000 Mizuno ..... 204/286.1

FOREIGN PATENT DOCUMENTS

| | | |
|---|---|---|
| JP | 58-58300 | 4/1983 |
| JP | 3081558 | 11/1998 |
| JP | 11-12791 | 1/1999 |
| JP | 2007-39779 | 2/2007 |

OTHER PUBLICATIONS

International Search Report dated Jun. 26, 2007 for International Application No. PCT/JP2007/056263.

* cited by examiner

*Primary Examiner* — Bruce Bell
(74) *Attorney, Agent, or Firm* — Wenderoth, Lind & Ponack, L.L.P.

(57) ABSTRACT

An insulating spacer 30 comprises a plurality of unit spacers 40, and a flexible coupling portion 41 for coupling the unit spacers 40 along the axial direction thereof, wherein the unit spacer 40 comprises a plurality of annular plates 42 and 43 each having an insertion hole 44 for inserting the auxiliary anode 11, and a coupling frame 45 for coupling the annular plates 42 and 43 in the axial direction of the auxiliary anode 11 while opening the outer circumference side thereof. The auxiliary anode unit 10 is constituted by inserting the insulating spacer 30 into the auxiliary anode 11, and since each unit spacer 40 is coupled, the distal end of the auxiliary anode 11 is naturally located in proximity to the insertion hole 44 provided in the next unit spacer 40 when the auxiliary anode 11 penetrates one unit spacer 40. Accordingly, the auxiliary anode 11 can be inserted into the insulating spacer 30 by series of works, and as a result, the auxiliary anode unit 10 can be manufactured with good workability.

17 Claims, 9 Drawing Sheets

INSULATING SPACER FOR PLATING INNER SURFACE AND AUXILIARY ANODE UNIT

TECHNICAL FIELD

The present invention relates to an insulating spacer and an auxiliary anode unit preferably used for plating the inner surface of a tubular object to be plated, particularly a bent tube.

BACKGROUND ART

The electroplating is generally conducted by immersing an electrode and an object to be plated into a plating liquid containing a plating metal dissolved therein, and then applying an electrical current between both parties, the electrode as anode and the object to be plated as cathode. Here, when the object to be plated is a tube, plating on the inner surface side thereof becomes excessively insufficient compared to the outer surface side, since the inner surface is hidden from the electrode and the electrical current is therefore insufficient. On the other hand, as a countermeasure against the above, an auxiliary anode has been disposed in the tube so as to improve the electrical current distribution. In that case, when the tube is a straight tube, the auxiliary anode may be passed concentrically inside of its hollow as vertically immersing the straight tube, however, this method cannot be employed when the tube is a bent tube curved in the middle thereof.

Considering the foregoing, as a method for dealing with a case where the above-mentioned object to be plated is a bent tube curved in the middle thereof, there has been provided an auxiliary anode unit having an insulating spacer mounted to a flexible and linear auxiliary anode, which is inserted into the bent tube (for example, see Patent literature 1).

[Patent literature 1]: Japanese Patent Registration No. 3081558 (FIG. 9)

DISCLOSURE OF THE INVENTION

Problem to be Solved by the Invention

However, according to the invention in Patent literature 1, the insulating spacer has a relatively short cylindrical shape, and a large number thereof are mounted to the outer circumference of an auxiliary anode so as to form the auxiliary anode unit. Therefore, the separate insulating spacers need to be mounted to the auxiliary anode one by one, and the workability in manufacturing the auxiliary anode unit has been extremely poor. This invention has been completed based on the above circumstances, and its purpose is to improve the workability in manufacturing an auxiliary anode unit used for plating the inner surface of a tubular and curved object to be plated.

Means for Solving the Problem

An insulating spacer according to the present invention is used for plating the inner surface of a tubular object to be plated along with an auxiliary anode to be inserted into the tubular object to be plated. The insulating spacer according to the present invention comprises a plurality of unit spacers, and a flexible coupling portion for coupling the unit spacers along the axial direction of the auxiliary anode, wherein the unit spacer comprises a plurality of annular plates each having an insertion hole for inserting the auxiliary anode, and a coupling frame for coupling the annular plates in the axial direction of the auxiliary anode while opening the outer circumference side thereof. In addition, the auxiliary anode unit is constituted by mounting the insulating spacer according to the above configuration to the outer circumference of the flexible auxiliary anode.

With the above configuration, a plurality of the unit spacers are coupled by the flexible coupling portion so as to compose the insulating spacer. Therefore, when mounting the insulating spacer to the auxiliary anode, the distal end of the auxiliary anode is inserted into the unit spacer positioned at the end, then into the continuing unit spacer positioned at the second. This is repetitively conducted for the number of the unit spacers. When the distal end of the auxiliary anode is in a penetrated state through one unit spacer, since the unit spacer is coupled with the next unit spacer through the coupling portion, the distal end of the auxiliary anode is naturally located in proximity to the insertion hole provided in the next unit spacer, and thus, the auxiliary anode can be inserted into the insulating spacer by series of works.

Additionally, since a plurality of unit spacers are coupled so as to compose an insulating spacer, each unit spacer does not need to be unmolded separately from the mold when molding the insulating spacer. This means, pulling out one unit spacer can unmold the whole insulating spacer. Accordingly, the manufacturability in manufacturing the insulating spacer can also be enhanced.

In addition, as an aspect of the invention, the coupling portion may be in a thin and rod-like shape placed in an eccentric position on the outer surface of the annular plate provided in the end of the unit spacer. According to this configuration, when the insulating spacer is mounted to the auxiliary anode, the surface area of the auxiliary anode to be covered by the unit spacer and the coupling portion can be smaller. This achieves the uniformity of the electrical current distribution on the inner surface area of the tubular object to be plated, and thereby obtaining the uniformity of plating thickness. Furthermore, three or more unit spacers may be coupled, and the coupling portions positioned between each unit spacer may be in the same position when viewed form the axial direction of the unit spacer. With this configuration, the coupling portions in a thin and rod-like shape provided in the eccentric position in the annular plate are linearly-arranged in the axial direction of the unit spacer, and the insulating spacer can therefore bend at a large angle with the coupling portion positioned inner side, and also, can bend in accordance with the sharp-angled bend part of the tubular object to be plated.

In addition, as another aspect of the invention, three or more annular plates may be provided in each unit spacer, and the annular plates positioned in both ends of the unit spacer may have a smaller external diameter than that of the annular plate positioned in the center. According to this configuration, the unit spacer becomes cylindrical with its central part in the axial direction thick, and therefore, when being bent and inserted into the tubular object to be plated so as to contact with the inner surface of the tubular object to be plated, the outer circumferences of the most protruding center and both ends are locally point-contacted with the inner circumferential surface of the tubular object to be plated, and thereby preventing and suppressing occurrence of an unplated area in the inner surface plating.

According to the present invention, the auxiliary anode unit used for plating the inner surface of a tubular and curved object to be plated can be expected to be manufactured with good workability.

DESCRIPTION OF SYMBOLS

Figure 1:
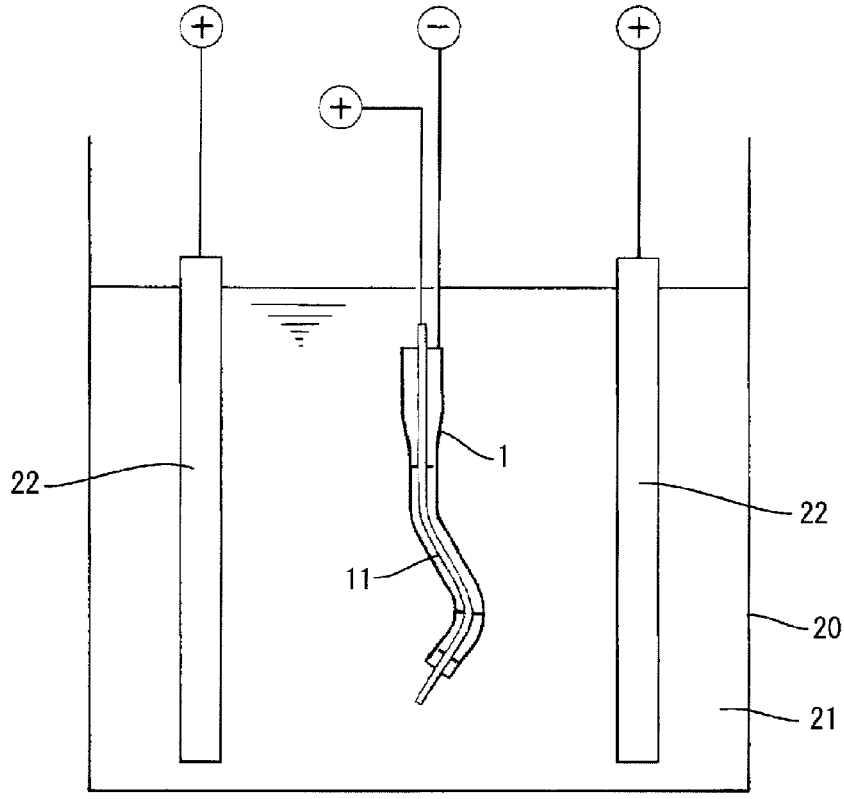
FIG. 1 is a schematical cross-sectional view of a plating bath.

10 . . . auxiliary anode unit 11 . . . auxiliary anode 30 . . . insulating spacer 40, 50, 60 . . . unit spacer 41 . . . coupling portion 42, 62 . . . end annular plate 43 . . . central annular plate 44 . . . insertion hole 45, 55 . . . coupling frame 57 . . . pointed end part 68 . . . projecting portion

BEST MODE FOR CARRYING OUT THE INVENTION

Embodiment 1

Figure 3:
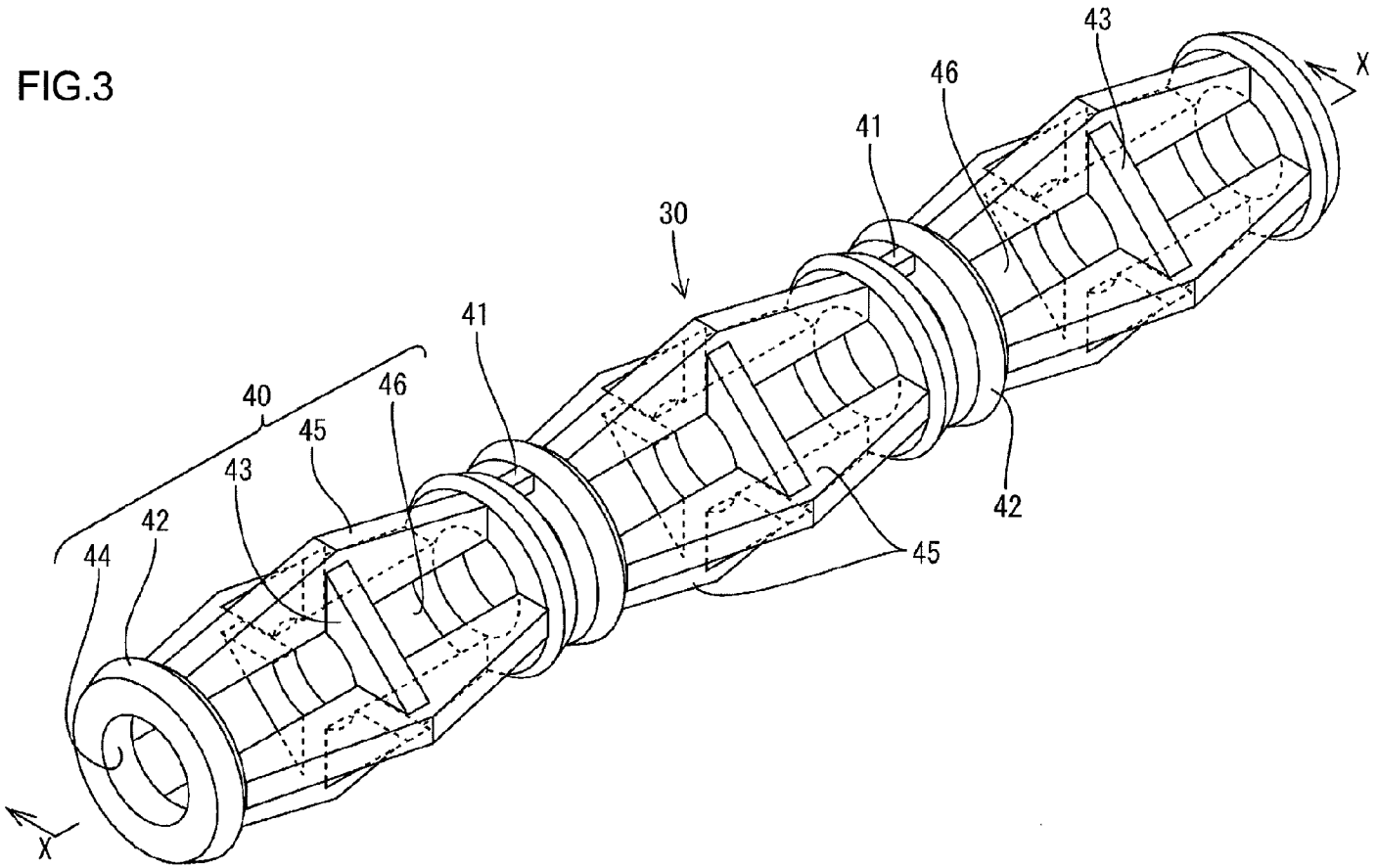
FIG. 3 is a perspective view of an insulating spacer according to Embodiment 1 in the present invention.
Figure 4:
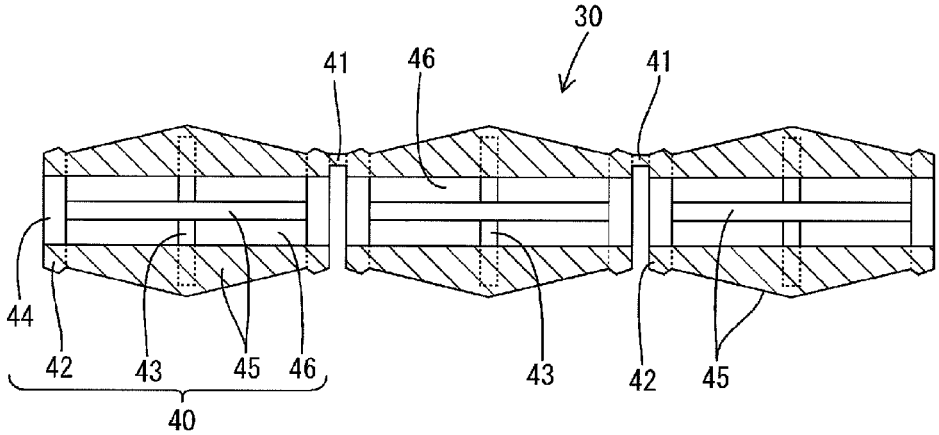
FIG. 4 is a cross-sectional view taken along a line X-X in FIG. 3.
Figure 5:
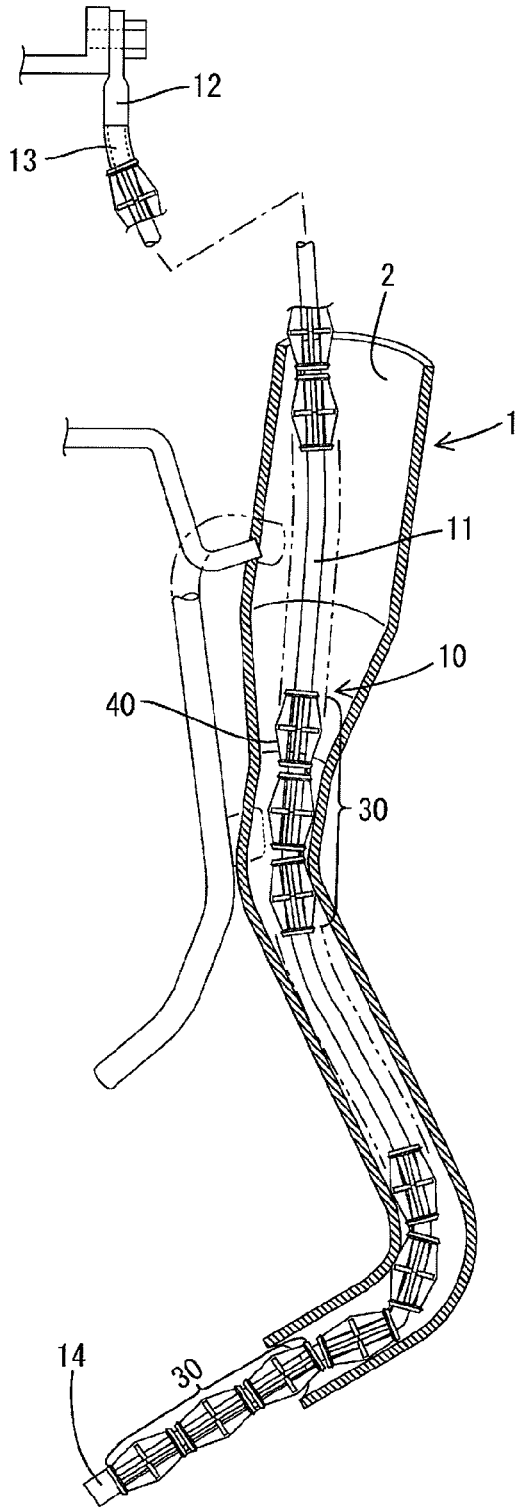
FIG. 5 is a cross-sectional view showing the auxiliary anode unit inserted into a filler pipe.

In what follows, Embodiment 1 of the present invention is described as referring to FIGS. 1 to 5. In this embodiment, a case for galvanizing a filler pipe 1 as a pipe at a gasoline tank inlet in a vehicle is shown by example. This filler pipe 1 is, as shown in FIG. 5, made from a steel product and formed in a bent tube shape, wherein the head of the straight part continuing to an inlet 2 is squeezed and then bent obtusely in one direction, and then, the end is further bent back at nearly a right angle.

The filler pipe 1 as mentioned above is suspended via a hanger not shown and delivered on a line, with the auxiliary anode unit 10 as explained later in details inserted thereinto. While being delivered, the filler pipe 1 is sequentially subjected to: pretreatment processes such as degreasing and washing, galvanizing process, washing, chromating, aftertreatment processes such as drying, and then is taken out as a plated product.

A plating bath 20 is used for the galvanizing process as shown in FIG. 1. The plating bath 20 is filled with a plating liquid 21. The plating liquid 21 contains, for example, zinc (Zn) of 20 g/L, sodium hydroxide (NaOH) of 60 g/L, sodium cyanide (NaCN) of 50 g/L respectively. Additionally, the temperature of the plating liquid 21 is kept from 25 to 30 degrees C. (cyanide plating bath). Bath not containing sodium cyanide (so called, zincate bath) may also be applied.

Zinc plates 22 suspended in both sides inside of the plating bath 20 and immersed therein are respectively connected to the anode of a power source supplying device not shown. When the above-mentioned filler pipe 1 is immersed in the center of the plating bath 20 with the auxiliary anode unit 10 inserted thereinto, the filler pipe 1 is simultaneously connected to the cathode in the power source supplying device, whereas the auxiliary anode 11 is to the anode of the same, both via the hanger.

As a result, in the plating liquid 21, the electrical current flows from both zinc plates 22 and the auxiliary anode 11 connected to the anode to the filler pipe 1 connected to the cathode, and thereby zinc plating both the inner and outer surfaces of the filler pipe 1 is performed. This zinc plating process is performed for 20 plus a few minutes. When the zinc plating process was completed, the filler pipe 1 is sequentially subjected to the above-mentioned aftertreatment processes such as washing, chromating, and drying, and then is taken out as a product.

Figure 2:
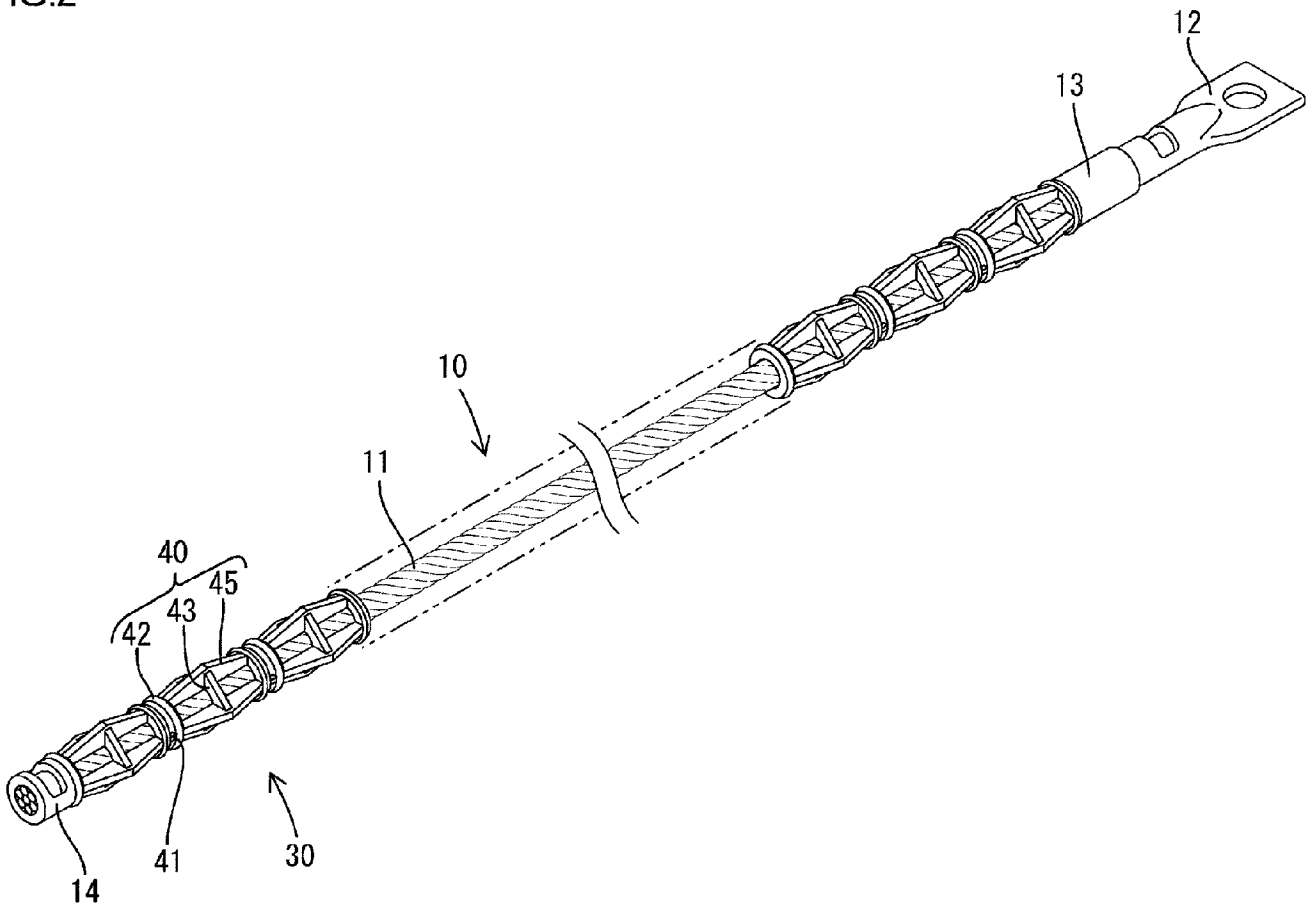
FIG. 2 is a perspective view of a partially-notched auxiliary anode unit.

Next, the configuration of the auxiliary anode unit 10 is explained. The auxiliary anode unit 10 is composed of the auxiliary anode 11 and the insulating spacer 30 as shown in FIG. 2. The auxiliary anode 11 is flexible and formed in a wire shape by twisting a large number of stainless steel wires, and can be inserted into the inner surface of the filler pipe 1 with a clearance. A connector 12 is rigidly fixed to one end of the auxiliary anode 11 and to be connected to the hanger.

In the present embodiment, the insulating spacer 30 is constituted by connecting, for example, three unit spacers 40 at each end in the axial direction through a coupling portion 41, and mounted to the outer circumference of the auxiliary anode 11.

The unit spacer 40 is made from polypropylene (PP) and molded into a shape as shown in FIGS. 3 and 4. In details, a central annular plate 43 having a dimension larger than that of an end annular plate 42 is disposed between two end annular plates 42. In addition, the end annular plate 42 has a circular shape, while the central annular plate 43 has a square shape, both having an insertion hole 44 at each center for inserting the auxiliary anode 11. In a manner so as to connect between these annular plates 42 and 43, four coupling frames 45, each forming a plate shape, are integrally molded with each annular plate 42 and 43 at angle intervals of 90 degrees.

Each coupling frame 45 is extending in the axial direction of the unit spacer 40, with its plate surface directed along the radiation direction of the end annular plate 42. The section continuing to the inner circumference side of the end annular plate 42 in each coupling frame 45 extends linearly in the axial direction of the unit spacer 40, while the section continuing to the outer circumference side of the end annular plate 42 forms a crest shape with the largest width in the section continuing to the central annular plate 43. Four coupling frame 45 are disposed at equal angle intervals relative to each annular plate 42 and 43, and moreover, have a crest shape at the central part in the outer circumference, so that the unit spacer 40 is a cylindrical shape, having a wide opening 46 in its circumferential surface and the thick center in the axial direction.

According to the present embodiment, three unit spacers 40 are provided, and thus, two coupling portions 41 are arranged between the adjacent unit spacers 40. These coupling portions 41 are molded integrally with the unit spacer 40, and flexible due to its material of polypropylene (PP). Each of the coupling portions 41 is provided in the outer fringe of the outer side surface in the end annular plate 42 (in short, the eccentric position), that is in the same position viewed from the axial direction of the unit spacer 40.

Next, the working and effect of the present embodiment is described. The auxiliary anode unit 10 is manufactured in a manner that a cushion tube 13 is mounted to the base end side of the auxiliary anode 11 before the insulating spacer 30 is mounted thereon, and then a stopper 14 is finally attached to the distal end of the auxiliary anode 11.

When manufacturing the auxiliary anode unit 10, the distal end of the auxiliary anode 11 is inserted into the insertion hole 40 provided in the end annular plate 42 of the endmost unit spacer 40, and then inserted into the insertion hole 44 in the central annular plate 43, before being inserted in to the insertion hole 44 in the end annular plate 42 in the opposite side. When the distal end of the auxiliary anode 11 penetrates through one unit spacer 40, since the unit spacer 40 is coupled with the next unit spacer 40 through the coupling portion 41, the distal end of the auxiliary anode 11 is naturally located in proximity to the insertion hole 44 provided in the next unit spacer 40. Here, the distal end of the auxiliary anode 11 is further inserted from the end annular plate 42 in the next unit spacer 40, then into the insertion holes 44 in each annular plate 43 and 42. In this manner, the auxiliary anode 11 is inserted also into the third unit spacer 40. In addition, when the length of one insulating spacer 30 (the length for three unit spacers 40) is shorter than that of the auxiliary anode 11, a required number of the insulating spacers 30 may further be mounted in the same manner.

As mentioned, since three unit spacers 40 composing the insulating spacer 30 are coupled each other through the coupling portion 41 in the present invention, the auxiliary anode 11 can be inserted into the insulating spacer 30 by series of works, and as a result, the auxiliary anode unit 10 can be manufactured with good workability.

When the auxiliary anode unit 10 in a state having the insulating spacer 30 mounted to the auxiliary anode 11 is inserted into the filler pipe 1, and if the filler pipe 1 is curved, the auxiliary anode unit 10 naturally curves in compliance with the shape of the pipe 1, and bending force thereby works on the auxiliary anode unit 10. In the present invention, the auxiliary anode 11 constituting the auxiliary anode unit 10 is flexible, and moreover, each coupling portion 41 in the insulating spacer 30 is also flexible. Therefore, as shown in FIG. 5, the auxiliary anode unit 10 is inserted into the filler pipe 1 as curving in compliance with the shape of the pipe 1, while accordingly bending the coupling portion 41 in each unit spacer 40.

Here, in the present embodiment, two thin and rod-shaped coupling portions 41 are provided in the eccentric positions, that are the same each other in the outer side surface of the end annular plate 42 when viewed from the axial direction of the unit spacer 40. With this configuration, when the insulating spacer 30 is bent with the coupling portions 41 aligned linearly in its axial direction in the outer side, the end annular plates 42 in each unit spacer 40 come into contact each other when bent for a certain level, and there occurs a limit of the bending angle of the insulating spacer 30. On the other hand, when the insulating spacer 30 is bent with the coupling portions 41 positioned inner side, the end annular plates 42 move in such a direction that they separate from each other, so as not to come into contact. Therefore, the flexibility of the insulating spacer 30 is not limited by the bending angle, having a high degree of freedom.

As mentioned above, the insulating spacer 30 has a limit in bending angle, when is bent with the coupling portion 41 positioned outer side. Accordingly, when inserting the auxiliary anode unit 10 into the filler pipe 1, and when the auxiliary anode unit 10 with the coupling portion 41 positioned in the outer side reaches a bend part in the filler pipe 1, the bending angle of the insulating spacer 30 may reach the limit when bent for a certain level. Consequently, the auxiliary anode unit 10 might not be inserted, since it could not bend enough to be in compliance with the shape of the filler pipe 1. However, it is confirmed that the following phenomenon actually occurs, and thereby preventing the above-mentioned failure from occurring.

As tucking the auxiliary anode unit 10 into the filler pipe 1, the insulating spacer 30 comes to be bent to the limit of the bending angle, and causes a large insertion resistance to generate. Here, when the auxiliary anode unit 10 is slightly moved forward and backward by being tucked more and pulled out, the insulating spacer 30 abuts on the inner wall of the bend part in the filler pipe 1 little by little, and with this shock, the insulating spacer 30 rotates about the auxiliary anode 11. This allows the coupling portion 41 to be gradually positioned into the inner side of the bend part, enabling the insulating spacer 30 to be easily bent in compliance with the curvature of the bend part in the filler pipe 1. Eventually, the auxiliary anode unit 10 can bend in compliance with the curvature of the filler pipe 1.

As mentioned above, in the present embodiment, the thin and rod-shaped coupling portions 41 are provided in the eccentric positions that are the same each other on the outer side surface of each end annular plate 42. Consequently, the auxiliary anode unit 10 can bend at a large angle and also in compliance with a sharp bend part in the filler pipe 1, when the coupling portion 41 is positioned in the inner side.

Additionally, in the present embodiment, the external diameter of the end annular plate 42 is smaller than that of the central annular plate 43, so that the unit spacer 40 has a cylindrical shape, with the center part in the axial direction thick and both ends thin. Therefore, even if the auxiliary anode unit 10 is bent as being inserted into the filler pipe 1, and the unit spacer 40 comes in contact with the inner surface of the filler pipe 1, only the center part (in short, the central annular plate 43) most protruding in the unit spacer 40, or only both the central annular plate 43 and the end annular plate 42 are merely point-contacted with the inner surface of the filler pipe 1. Therefore, almost the entire inner surface of the filler pipe 1 comes into contact with the plating liquid, and thereby suppressing or preventing occurrence of an unplated area in the inner surface plating.

Furthermore, particularly in the present embodiment, the central annular plate 43 in the unit spacer 40 is square, so that, when one vertex of the central annular plate 43 is point-contacted with the inner surface of the filler pipe 1, there occurs a clearance having a relatively large approximate angle between the outer circumferential surface of the central annular plate 43 and the inner surface of the filler pipe 1 with the above contacted point as a vertex. As a result, occurrence of an unplated area in the inner surface plating can be certainly prevented.

Embodiment 2

Figure 6:
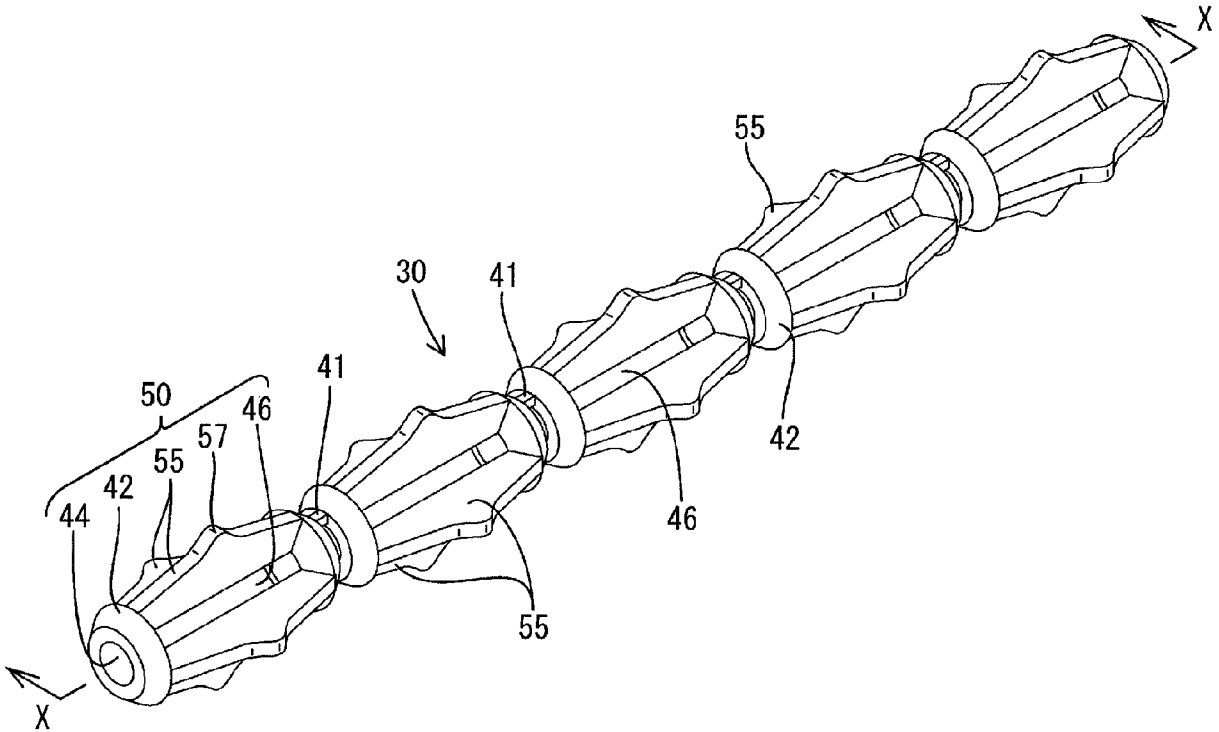
FIG. 6 is a perspective view of an insulating spacer according to Embodiment 2 in the present invention.
Figure 7:
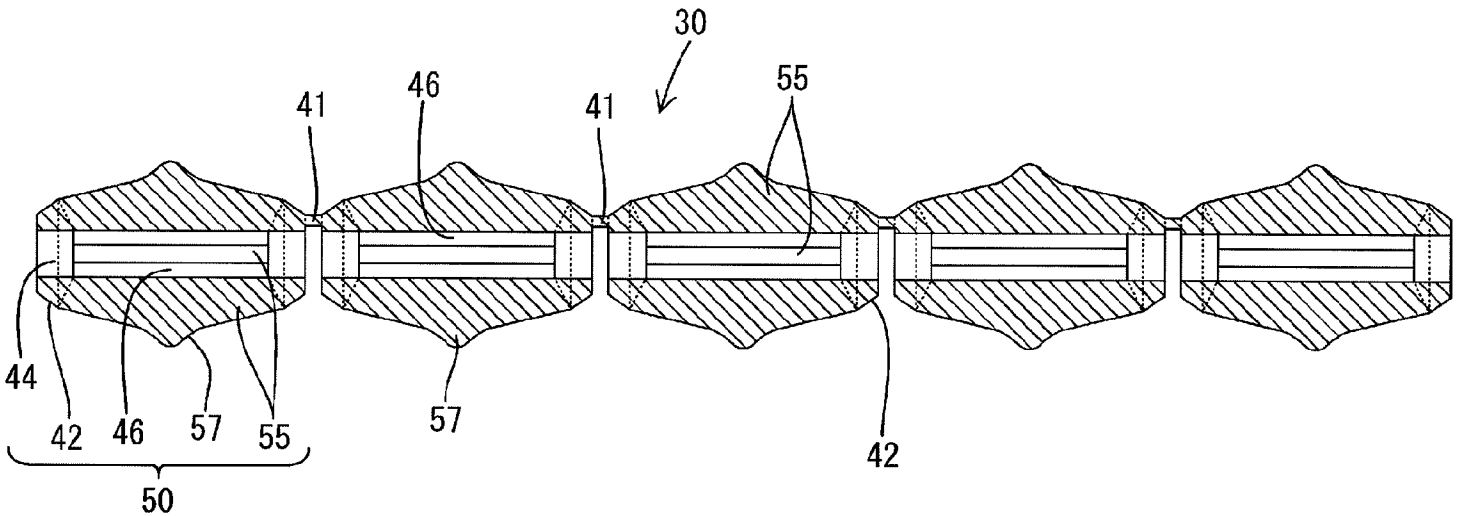
FIG. 7 is a cross-sectional view taken along a line X-X in FIG. 6.

As referring now to FIGS. 6 and 7, Embodiment 2 of the present invention is described. The difference from Embodiment 1 lies in the change of the configuration of the unit spacer, and others are the same as the above embodiment. The same numerals are allotted to the same elements as those in the above-mentioned embodiment, and description thereof is omitted.

An unit spacer 50 is composed of two end annular plates 42 in a circular shape and four coupling frames 55 in a plate shape integrally molded with the end annular plate 42 at angle intervals of 90 degrees in a manner so as to connect the end annular plates 42. The section continuing to the inner circumference side of the end annular plate 42 in each coupling frame 55 extends linearly in the axial direction of the unit spacer 50. On the other hand, the section continuing to the outer circumference side of the end annular plate 42 extends in an arc shape toward the pointed end part 57 positioned in the center in the length direction of the coupling frame 55.

When plating the filler pipe 1 with this unit spacer 50, the pointed end part 57 in the coupling frame 55 and a part of the outer circumference of the end annular plate 42 are point-contacted with the inner surface of the filler pipe 1. Therefore, almost the entire inner surface of the filler pipe 1 comes into contact with the plating liquid, and thereby preventing occurrence of an unplated part in the inner surface plating.

Embodiment 3

Figure 8:
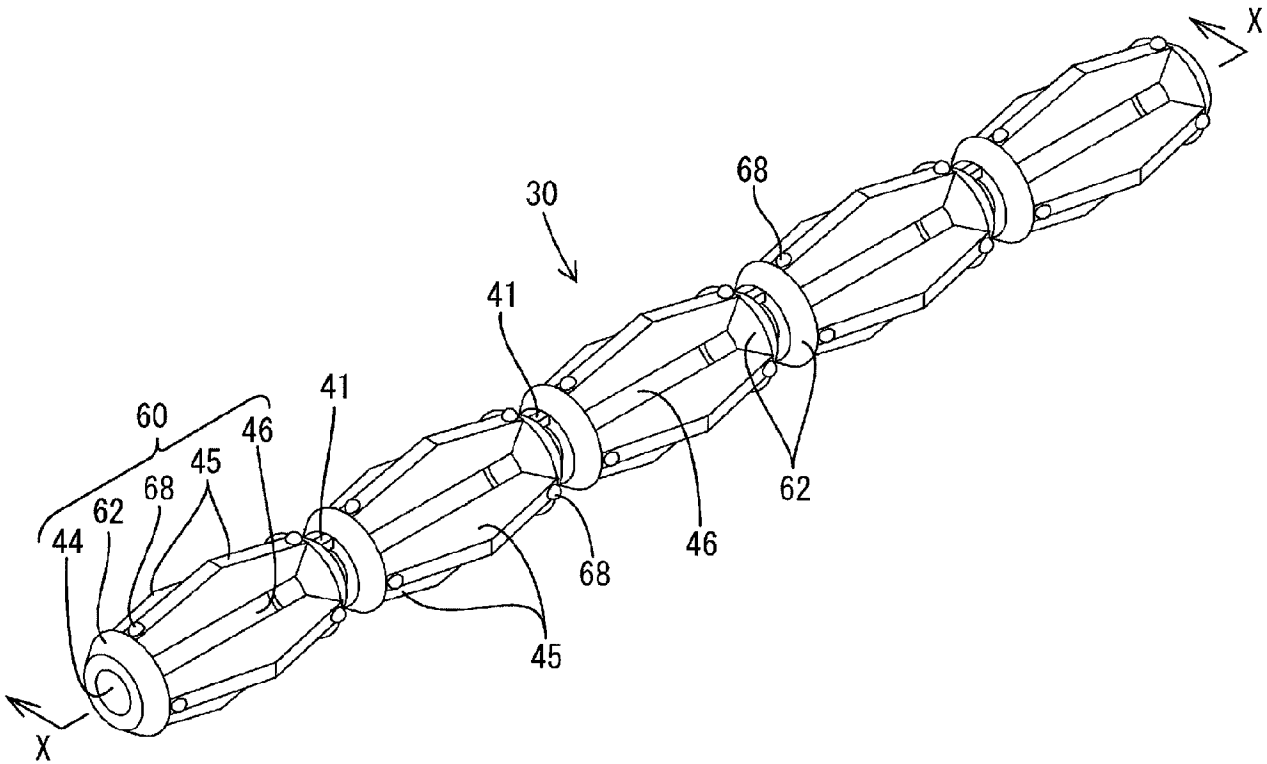
FIG. 8 is a perspective view of an insulating spacer according to Embodiment 3 in the present invention.
Figure 9:
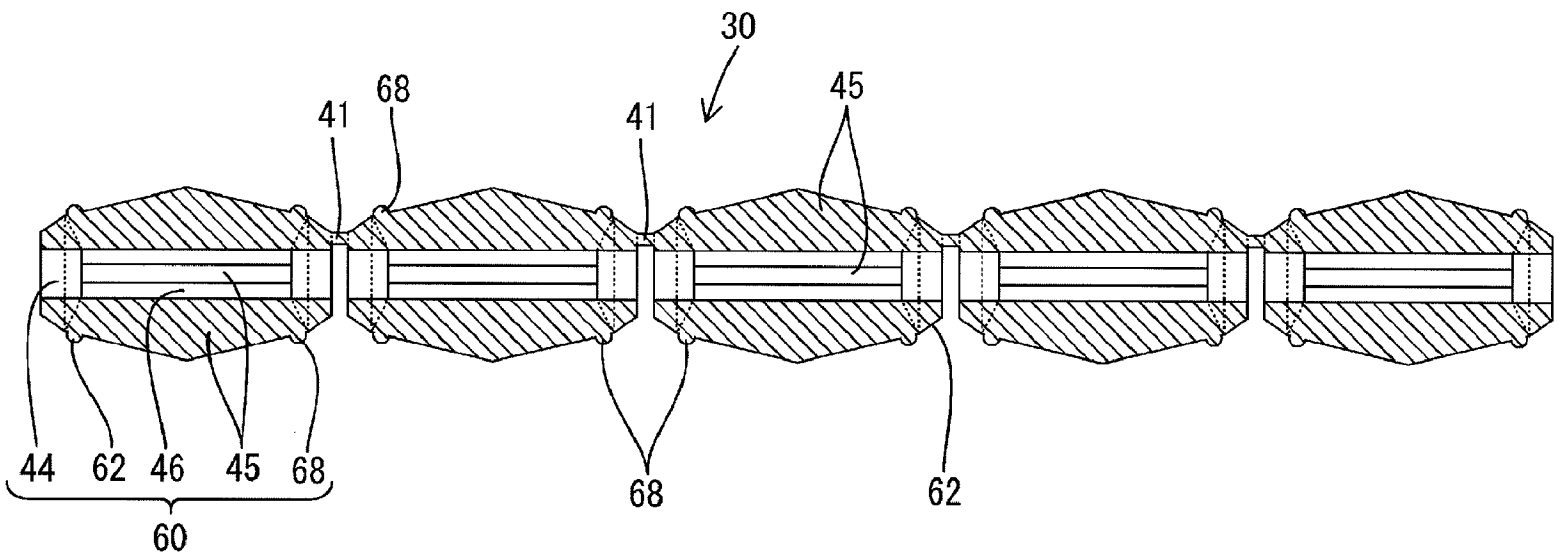
FIG. 9 is a cross-sectional view taken along a line X-X in FIG. 8.

As referring now to FIGS. 8 and 9, Embodiment 3 of the present invention is described. The difference from Embodiments 1 and 2 lies in the further change of the configuration of the unit spacer, and others are the same as the above embodiments. The same numerals are allotted to the same elements as those in the above-mentioned embodiment, and description thereof is omitted.

An unit spacer 60 is constituted in a manner that four coupling frames 45 each forming a plate shape are provided so as to connect two end annular plates 62 in a circular shape. The section continuing to the inner circumference side of the end annular plate 62 in each coupling frame 45 extends linearly in the axial direction of the unit spacer 60, while the section continuing to the outer circumference side of the end annular plate 62 forms a crest shape with the largest width at the center in the length direction in the coupling frame 45. Moreover, provided in the joint part between the end annular plate 62 and the coupling frame 45 is a projecting portion 68 in nearly a conical shape, which is projecting from the end annular plate 62 to the outer circumference side and has a height higher than the outer peripheral edge part of the coupling frame 45.

When plating the filler pipe 1 with this unit spacer 60, the projecting portion 68 provided in the end annular plate 62 and the center part of the outer periphery in the length direction of the coupling frame 45 are point-contacted with the inner surface of the filler pipe 1. Therefore, almost the entire inner surface of the filler pipe 1 comes into contact with the plating liquid, and thereby surely preventing occurrence of an unplated part in the inner surface plating.

With embodiments of the present invention described above with reference to the accompanying drawings, it is to be understood that the invention is not limited to those precise embodiments, and the embodiments as below, for example, can be within the scope of the present invention.

(1) In the above-mentioned embodiments, the number of the unit spacers 40, which are connected so as to compose the insulating spacer 30, is three or five (the number of the coupling portion 41 is accordingly changed), however, the present invention is not limited to this, and the number may be accordingly changed.

(2) In the above-mentioned embodiments, the material of the unit spacer 40 and the coupling portion 41 is polypropylene (PP). However, as a material of the unit spacer 40, other insulating materials such as ceramic and polyethylene (PE) may be used. As a material of the coupling portion 41, other flexible insulating materials such as polyethylene (PE) may be used.

(3) In the above-mentioned embodiments, the shapes of the end annular plate 42 and the central annular plate 43 are respectively circular and square, however, they may be changed in accordance with the inner surface shape of a tubular object to be plated.

(4) In the above-mentioned embodiments, the coupling portion 41 is in a thin and rod-like shape, however, the present invention is not limited to this, and it may be in any shapes such as, for example, a plate shape and a cylindrical shape.

(5) In the above-mentioned embodiments, the position of the coupling portion 41 is the eccentric position of the end annular plate 42, however, the coupling portion 41 may be, for example, in a cylindrical shape extending in the axial direction of the unit spacer 40 along the circumference of the insertion hole 44 provided in the center of the end annular plate 42.

(6) In each the above-mentioned embodiment, the galvanizing process of a filler pipe is illustrated by examples, however, the present invention is not limited to this, and may be broadly applied to general inner surface plating of a bent tube. Moreover, it may be applied to general electroplating, other than galvanizing.

The invention claimed is:

1. An insulating spacer used with an auxiliary anode to be inserted into a tubular object to be plated, comprising: a plurality of unit spacers, and a flexible coupling portion for coupling the unit spacers along the axial direction of the auxiliary anode, wherein the unit spacer comprises a plurality of annular plates each having an insertion hole for inserting the auxiliary anode, and a coupling frame for coupling the annular plates in the axial direction of the auxiliary anode while opening the outer circumference side thereof.

2. The insulating spacer according to claim 1 wherein the coupling portion is in a thin and rod-like shape placed in an eccentric position on the outer surface of the annular plate provided in the end of the unit spacer.

3. The insulating spacer according to claim 2 wherein three or more unit spacers are coupled by two or more coupling portions, and the coupling portions positioned between each unit spacer are in the same position each other when viewed form the axial direction of the unit spacer.

4. The insulating spacer according to claim 3 wherein three or more annular plates are provided in each unit spacer, and the annular plates positioned in both ends of the unit spacer have a smaller external diameter than that of the other annular plate.

5. The insulating spacer according to claim 1 wherein the shape of the annular plate is polygonal.

6. The insulating spacer according to claim 2 wherein the shape of the annular plate is polygonal.

7. The insulating spacer according to claim 3 wherein the shape of the annular plate is polygonal.

8. The insulating spacer according to claim 4 wherein the shape of the annular plate is polygonal.

9. The insulating spacer according to claim 1, wherein a projecting portion, projecting from the annular plate to the outer circumference side and having a height higher than the outer peripheral edge part of the coupling frame, is provided in the joint part in the annular plate with the coupling frame.

10. An auxiliary anode unit to be inserted into a tubular object to be plated, composed of a flexible auxiliary anode capable of being inserted into the tubular object to be plated, and an insulating spacer mounted to the auxiliary anode, wherein the insulating spacer comprises a plurality of unit spacers and a flexible coupling portion for coupling the unit spacers along the axial direction of the auxiliary anode, and the unit spacer comprises a plurality of annular plates each having an insertion hole for inserting the auxiliary anode, and a coupling frame for coupling the annular plates in the axial direction of the auxiliary anode while opening the outer circumference side thereof.

11. The insulating spacer according to claim 2, wherein a projecting portion, projecting from the annular plate to the outer circumference side and having a height higher than the outer peripheral edge part of the coupling frame, is provided in the joint part in the annular plate with the coupling frame.

12. The insulating spacer according to claim 3, wherein a projecting portion, projecting from the annular plate to the outer circumference side and having a height higher than the outer peripheral edge part of the coupling frame, is provided in the joint part in the annular plate with the coupling frame.

13. The insulating spacer according to claim 4, wherein a projecting portion, projecting from the annular plate to the outer circumference side and having a height higher than the outer peripheral edge part of the coupling frame, is provided in the joint part in the annular plate with the coupling frame.

14. The insulating spacer according to claim 5, wherein a projecting portion, projecting from the annular plate to the outer circumference side and having a height higher than the outer peripheral edge part of the coupling frame, is provided in the joint part in the annular plate with the coupling frame.

15. The insulating spacer according to claim 6, wherein a projecting portion, projecting from the annular plate to the outer circumference side and having a height higher than the outer peripheral edge part of the coupling frame, is provided in the joint part in the annular plate with the coupling frame.

16. The insulating spacer according to claim 7, wherein a projecting portion, projecting from the annular plate to the outer circumference side and having a height higher than the outer peripheral edge part of the coupling frame, is provided in the joint part in the annular plate with the coupling frame.

17. The insulating spacer according to claim 8, wherein a projecting portion, projecting from the annular plate to the outer circumference side and having a height higher than the outer peripheral edge part of the coupling frame, is provided in the joint part in the annular plate with the coupling frame.

* * * * *